US007360849B2

(12) United States Patent
Atkinson

(10) Patent No.: US 7,360,849 B2
(45) Date of Patent: Apr. 22, 2008

(54) LAVA-BRICK

(76) Inventor: Richard Warren Atkinson, Route #4, Box 54-B, Evans Mill Rd., Pageland, SC (US) 29728

( * ) Notice: Subject to any disclaimer, the term of this patent is extended or adjusted under 35 U.S.C. 154(b) by 0 days.

(21) Appl. No.: 09/790,129

(22) Filed: Feb. 21, 2001

(65) Prior Publication Data

US 2004/0212281 A1 Oct. 28, 2004

Related U.S. Application Data

(60) Provisional application No. 60/187,322, filed on Mar. 6, 2000.

(51) Int. Cl.
*A47B 88/00* (2006.01)

(52) U.S. Cl. ..... 312/321.5; 312/242; 312/305

(58) Field of Classification Search ..... 312/242, 312/204, 326, 327, 321.5, 206; 49/394; 292/DIG. 57, 292/DIG. 73

See application file for complete search history.

(56) References Cited

U.S. PATENT DOCUMENTS

| | | | | | |
|---|---|---|---|---|---|
| 1,952,686 | A | * | 3/1934 | Sakier | 312/242 |
| 2,039,065 | A | * | 4/1936 | Nicholas | 312/242 |
| 2,538,233 | A | * | 1/1951 | Brandstrom | 312/242 |
| 2,790,692 | A | * | 4/1957 | Sharpe | 312/242 X |
| 2,794,698 | A | * | 6/1957 | Chamberlin | 312/242 |
| 2,965,429 | A | * | 12/1960 | Stanger | 312/242 |
| 2,996,346 | A | * | 8/1961 | Sharpe | 312/242 |
| 3,062,606 | A | * | 11/1962 | Magrauth | 312/242 X |
| 3,220,791 | A | * | 11/1965 | Pokryfke et al. | 312/242 |
| 3,305,284 | A | * | 2/1967 | Dusterhoft | 312/242 |
| 4,033,650 | A | * | 7/1977 | Alissandratos | 312/242 X |
| 4,252,387 | A | * | 2/1981 | Wagner | 312/204 |
| 4,317,605 | A | * | 3/1982 | Alissandratos | 312/242 |
| 4,419,939 | A | * | 12/1983 | Reverte | 312/204 X |
| 5,893,531 | A | * | 4/1999 | Taylor et al. | 312/34.2 |
| 5,921,645 | A | * | 7/1999 | Lapi | 312/242 |

FOREIGN PATENT DOCUMENTS

| | | | | |
|---|---|---|---|---|
| DE | 3229475 | * | 2/1984 | 312/242 X |
| JP | 06030821 | * | 2/1994 | 312/204 X |

* cited by examiner

*Primary Examiner*—Lanna Mai
*Assistant Examiner*—Hanh V. Tran
(74) *Attorney, Agent, or Firm*—F. Rhett Brockington

(57) ABSTRACT

An improved and concealed wall mounted soap storage device having a housing with an opening on one side, and a center rotating door closure member with a vertical wall that serves as a door, and a projecting soap tray that can rotate into the housing. The closure member is pivotally connected to the housing. The opening has stops that are raised dimples on the housing which restrain, but do not prevent rotation. The vertical wall is held in the open or closed position by the stops. When the vertical wall is pressed the vertical wall engages the restraining stops with sufficient force that the vertical wall moves past the stops and swing through the opening. As the vertical wall moves past the stops there is a snap. The soap tray can rotate into or out of the housing, whatever the case may be.

2 Claims, 3 Drawing Sheets

LAVA-BRICK

CROSS REFERENCE TO RELATED APPLICATIONS

This application claims the benefit of the priority filing date of the Provisional Patent Application Ser. No. 60/187,322 filed Mar. 6, 2000.

BACKGROUND OF THE INVENTION

1. Field of Invention:

The invention relates generally to a storage device, and more particularly to a convenient and concealed device for the storage of soap "inside" the wall of a residential or commercial building.

2. Description of Related Art:

The prior art, for instance U.S. Pat. No. 2,996,346 to Sharpe, teaches the use of concealed rotational doors, wherein the door is rigidly stopped by projecting pins that prevent the door from rotating any further in the direction of rotation, as the door cannot pass over the pins. What is needed is an invention that utilizes dimples which are stops that provide a "snap open" and "snap closed" operation of the rotational door closure, wherein the dimples restrain the of the door, but with sufficient pressure applied to the door allow the door to be rotated past the dimples.

Prior inventions utilize a more complex and more expensive to manufacture mechanism for the "locked in open" and "locked in closed" positions for their respective rotating doors.

SUMMARY OF THE INVENTION

The invention provides for a convenient and concealed device for the storage of a bar of soap "inside" the wall of a commercial or residential structure. Although it can be used indoors in a kitchen or bathroom for example, the invention it was designed primarily for use as a concealed soap receptacle, for instance to be located beside an outdoor faucet and the like. The invention comprises a housing with raised dimples that are stops, where the stops impart a snap action when the door is opened or closed.

OBJECTS AND ADVANTAGES

Accordingly, several objects and advantages of my invention are:

1. Provides a concealed and flush mounted device for "in the wall" storage.

2. Provides an easily accessible "push and rotate" door for acquirement of stored item(s).

3. Provides a water proof housing to prevent water from entering the device.

4. Provides high ribs and drainage holes in the tray to help keep stored articles "high and dry".

Note: further objects and advantages of my invention will become apparent from consideration of the drawings and ensuing description.

REFERENCE NUMERALS IN DRAWINGS

1 Concealed Storage Device

10 Housing

11 Stops

11A Left Stop

11B Right Stop

12 Pivot Pins

14 Top Side

15 Bottom Side

16 Right Side

17 Left Side

18 Rear Side

19 Outer Flange

19A Left Portion

19B Top Portion

19C Right Portion

19D Lower Portion

20 Closure member

22 Tray

22A Platform

22B Platform Surround Ridge

22C Raised Ridges

24 Vertical Wall

24A Left Side

24B Right Side

26 Drain Holes

28 Pivot Tube

28A Upper Area of Pivot Tube

28B Lower Area of Pivot Tube

DESCRIPTION OF THE INVENTION

Figure 1:
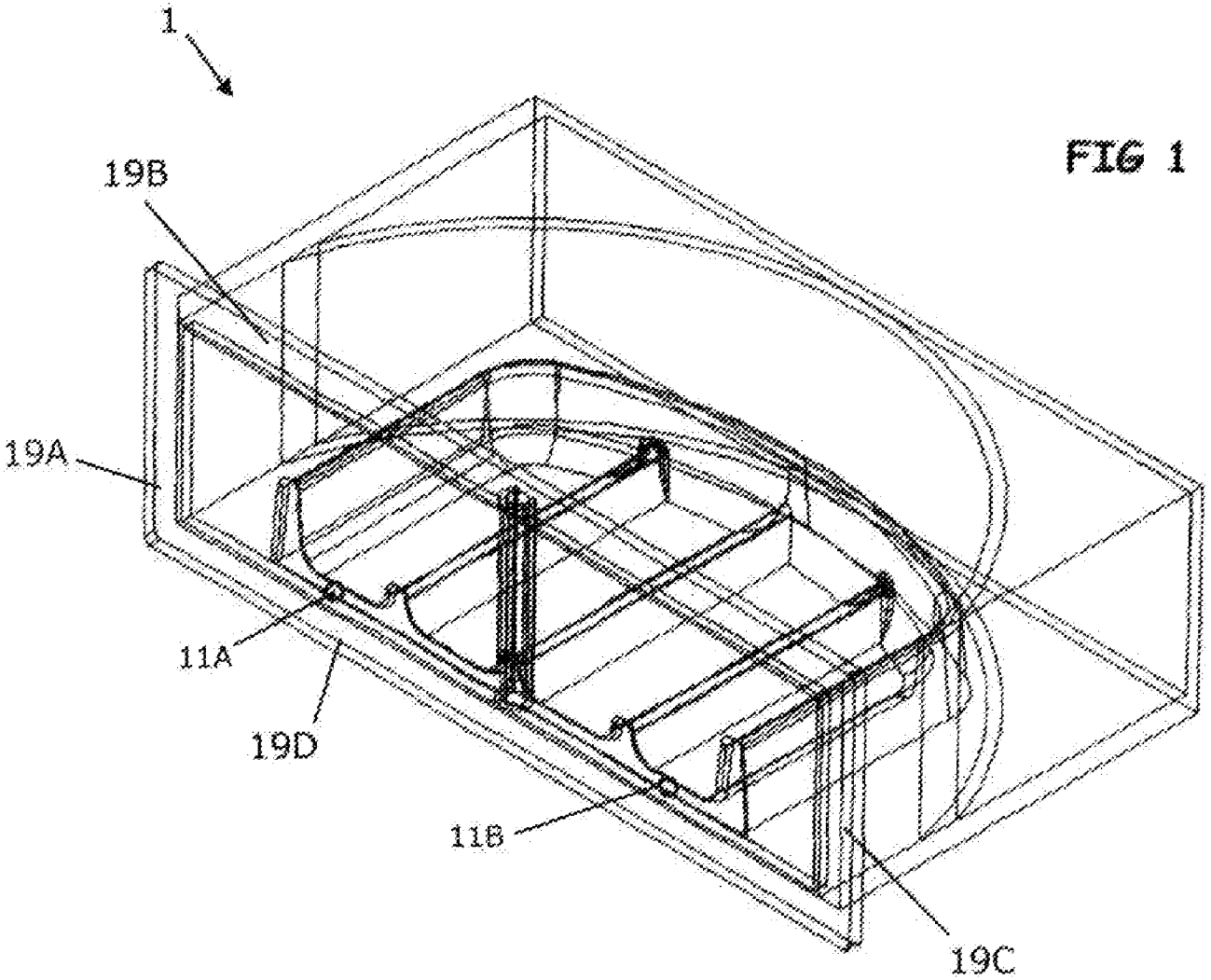
FIG. 1 is a front prospective view of the invention in the "closed" position.
Figure 2:
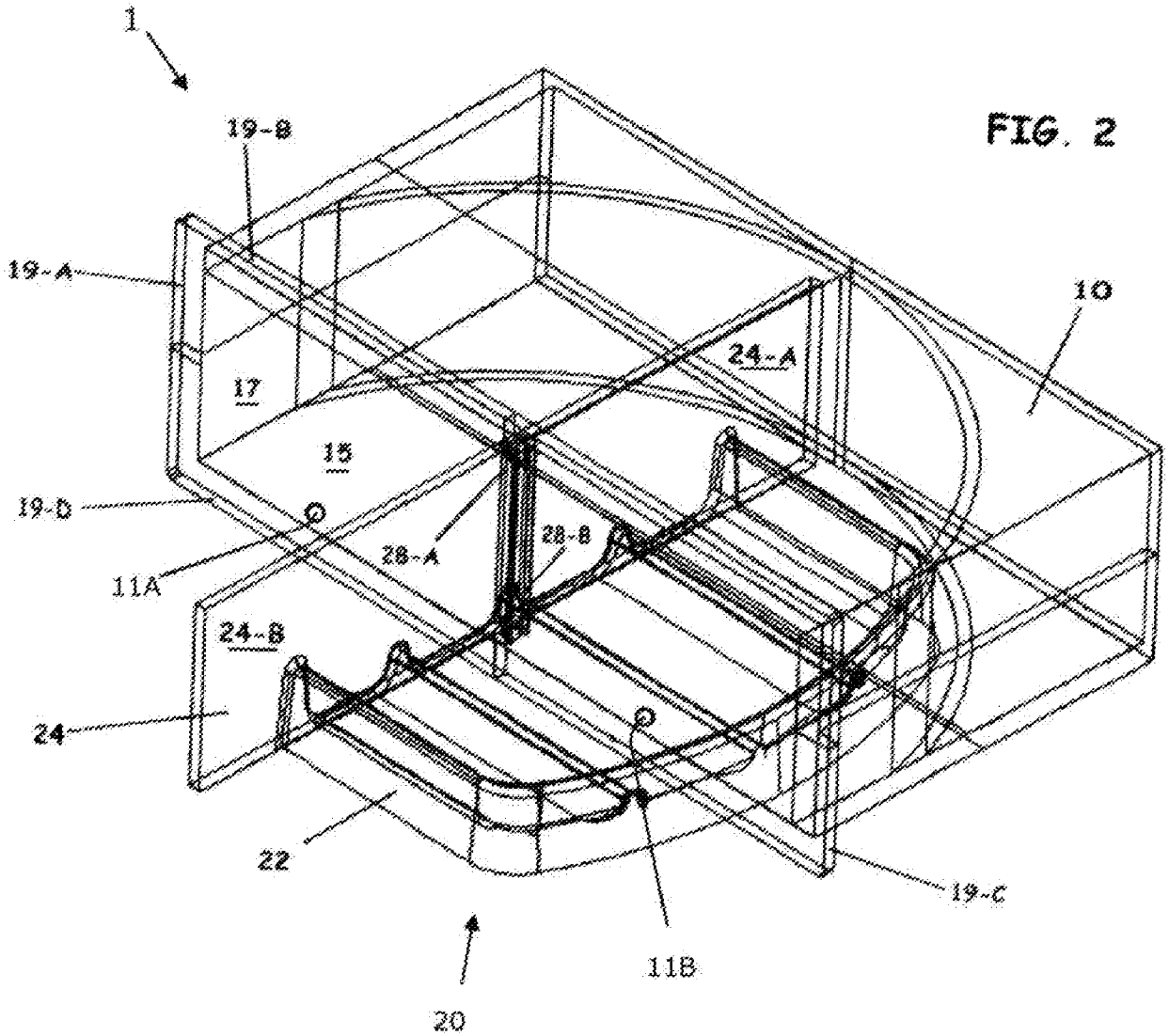
FIG. 2 is a front prospective view of the invention in the "half open" or "half closed" position.

The invention 1 is shown in FIG. 1 in the closed position. In the closed position the outside face of the vertical wall of the invention is flush when mounted in a wall structure. A stored item or items is/are concealed behind vertical wall 24. Vertical wall 24 can be best viewed in FIG. 2. The invention comprises an outer shell or housing 10. FIG. 2 illustrates that the housing 10 has raised dimples which are stops 11. There is a left stop 11A and a right stop 11B. The invention 1 also comprises a tray 22. The tray 22 is attached to the inside of the vertical wall 24, and taken together form a closure member 20, which serves as a center rotating door for the invented concealed storage device 1. The stops 11 prevent the closure member 20 from freely rotating.

Figure 3:
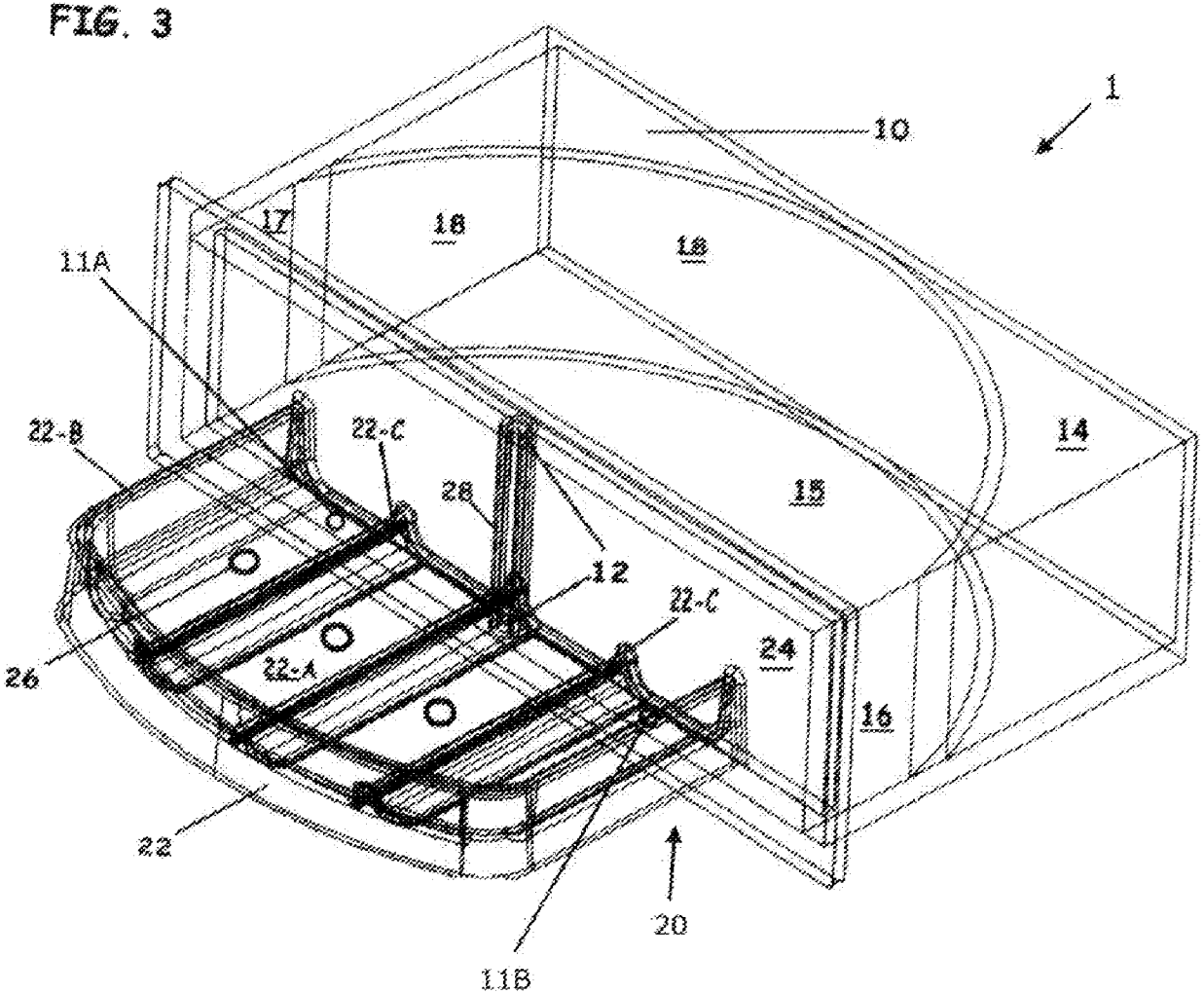
FIG. 3 is a front prospective view of the invention in the "fully open" position.

The housing 10 and the closure member 20 are attached via the upper and lower pivot pins 12 as seen in FIG. 3. The housing 10 is enclosed on five sides: top side 14, bottom side 15, right side 16, left side 17, and rear side 18 as depicted in FIGS. 2 and 3. The tray rotates through an opening into and out of the housing.

The tray 22 has a raised outer ridge or platform ridge 22B, several crossing raised ridges 22C, and also has weep or drain holes 26. See FIG. 3 for the drain holes 26.

The closure member 20 has a centrally located "straw like" or hollow pivot tube 28 as shown in FIG. 3. This pivot tube as illustrated in FIG. 2 has an upper area 28A and a lower area 28B.

FIGS. 2 and 3 depict the housing 10 as having an outer flange with the following 4 portions: flange/left hand portion 19A, flange/top portion 19B, flange/right hand portion 19C, and flange/lower portion 19D. The vertical wall 24 engages the raised dimples or stops 11 when the closure member is either opened or closed. When the vertical wall is pushed open or closed, the wall engages the stops with sufficient force to overcome the restraint of the stop, and the vertical wall passes by the stop. After the vertical wall passes, the disengagement creates a snap open, and snap shut operation, what ever the case may be.

The invention operates as follows. In order to "open"0 the invention in FIG. 1, we must "push" on either the left side 24A or the right side 24B of vertical wall 24. Vertical wall 24 is best depicted in FIG. 2. This "push" allows the tray 22 to "snap past" the stops 11 as the tray 22 "rotates" upon the pivot pins 12 of housing 10 as seen in FIG. 3. This rotation allows the tray 22 to "protrude" or "stick out" from the housing 10 and also to "protrude" from the structural wall in which the invention is installed. The stops 11 (e.g. 11A, 11B) prevent the tray 22 from rotating open when not desired as would perhaps happen by a slight external force such as the blowing of the wind.

When the tray 22 has fully rotated to the "open position" as shown in FIG. 3, the raised dimples are in front of the vertical wall, and then the tray 22 is accessible to the user to either "store an item" or to "acquire" a previously stored item. In order to "close" the invention, the user would just "push" on either the right side 24 B or the left side 24 A of vertical wall 24 as depicted in FIG. 2 or 3. This push will allow the tray 22 to revolve on pins 12 of housing 10 until tray 22 is back in the "closed" position as depicted in my first drawing, FIG. 1, and the raised dimples are behind the vertical wall. Once again the vertical wall of the invention is "flush" within the structural wall and the item or items are "concealed".

CONCLUSION, RAMIFICATIONS, AND SCOPE OF INVENTION

Thus the reader will see that this invention provides a convenient and easily accessible device for the "in the wall" storage of soap or other items. While the description contains many specificities, these should not be construed as limitations on the scope of the invention, but rather as an exemplification of one preferred embodiment thereof. Many variations are possible. For example, in FIG. 3, the tray 22 could be designed to pivot on the outer edge of vertical wall 24. This could be achieved by moving the pivot tube 28 and pivot pins 12 to the far right or far left of vertical wall 24. Another variation could be achieved by placing a small recessed handle on the exterior wall of the tray 24. By doing this and placing "slide rails" on tray 22 and housing 10. This would give the device a "slide drawer" type of operation.

The invention claimed is:

1. A storage device, said device comprising: a housing having a flanged opening with at least a left raised dimple and a right raised dimple on a bottom wall of the housing and a rotating door closure member, which rotates open or closed in either direction, comprised of a vertical wall having on one side a pivot tube and a tray projecting from the vertical wall, wherein the pivot tube is pivotally and centrally connected via pivot pins to the opening of said housing such that the vertical wall is offset from the pivot pins; where said at least left raised dimple and right raised dimple are positioned on opposing sides of the pivot pins, the raised dimples rising to a height just above a lower edge of the vertical wall where said raised dimple restrains but does not prevent rotation, wherein in the closed position the tray is inside the housing, and in the open position the tray is outside the housing, such that operatively when the closure member is closed said at least left raised dimple and right raised dimple are behind the vertical wall, and when the closure member is open said at least raised dimple and right raised dimple are in front of the vertical wall, and where, depending on the direction of rotation, said vertical wall engages either the left or the right dimple when the closure member is pushed open or closed, said push of sufficient force to overcome the raised dimple to let the vertical wall to move over the restraining raised dimple, said pushed open or closed movement having a snap open and snap shut operation.

2. The device of claim 1 wherein said tray is perforated therein permitting drainage while still retaining a unit of soap upon said tray.

* * * * *